US005424028A

United States Patent [19]

Maloney et al.

[11] Patent Number: 5,424,028

[45] Date of Patent: Jun. 13, 1995

[54] CASE CARBURIZED STAINLESS STEEL ALLOY FOR HIGH TEMPERATURE APPLICATIONS

[75] Inventors: James L. Maloney, South Greensburg; Colleen M. Tomasello, Scottdale, both of Pa.

[73] Assignee: Latrobe Steel Company, Latrobe, Pa.

[21] Appl. No.: 174,180

[22] Filed: Dec. 23, 1993

[51] Int. Cl.[6] ..... C21D 1/06; C22C 38/44; C22C 38/48

[52] U.S. Cl. ..... 420/38; 148/319; 148/221; 148/226; 148/233

[58] Field of Search ..... 420/38; 148/221, 226, 148/319, 233

[56] References Cited

U.S. PATENT DOCUMENTS

| | | | |
|---|---|---|---|
| T964,003 | 11/1977 | Rehrer | 75/128 |
| 2,590,835 | 4/1952 | Kirby et al. | 75/126 |
| 2,876,152 | 3/1959 | Jatczak | 148/31 |
| 3,154,412 | 10/1964 | Kasak et al. | 75/126 |
| 3,316,085 | 4/1967 | Grundman et al. | 75/128 |
| 3,663,208 | 5/1972 | Kirby et al. | 75/125 |
| 3,820,981 | 6/1974 | Wilde | 420/38 |
| 4,004,952 | 1/1977 | Jatczak et al. | 148/39 |
| 4,157,258 | 6/1979 | Philip et al. | 75/124 |
| 5,002,729 | 3/1991 | Wert et al. | 420/38 |

FOREIGN PATENT DOCUMENTS

| | | | |
|---|---|---|---|
| 51-41616 | 4/1976 | Japan | C22C 38/48 |
| 57-164977 | 10/1982 | Japan | 148/319 |
| 853124 | 6/1958 | United Kingdom . | |

OTHER PUBLICATIONS

"Martensitic Stainless Steels", *Stainless Steels And Heat-Resisting Alloys*, pp. 630–633. Metals Handbook, 9th Ed. vol. 4, Nov., 1981.

*Primary Examiner*—Deborah Yee

*Attorney, Agent, or Firm*—Webb Ziesenheim Bruening Logsdon Orkin & Hanson

[57] ABSTRACT

A case carburizable stainless steel alloy intended to be used at operating temperatures up to 700° F. The alloy is able to achieve and maintain a high surface hardness when carburized and heat treated and combines high fracture toughness, hot hardness, metal-to-metal wear resistance and corrosion resistance while retaining core ductility and strength. The alloy consists essentially of (in weight percent) 0.1 to 0.25% carbon, 0 to 1% silicon, 0 to 1% manganese, 13 to 19% chromium, 1.75 to 5.25% nickel, 3 to 5% molybdenum, 0.25 to 1.25% vanadium, 5 to 14% cobalt, 0.01 to 0.1% niobium; 0 to 0.02% boron; and the balance iron and incidental impurities. The alloy is particularly suited for use in bearing applications and also in cams, shafts, gears, bolts and like articles exposed to elevated temperatures and corrosive atmospheres.

14 Claims, 3 Drawing Sheets

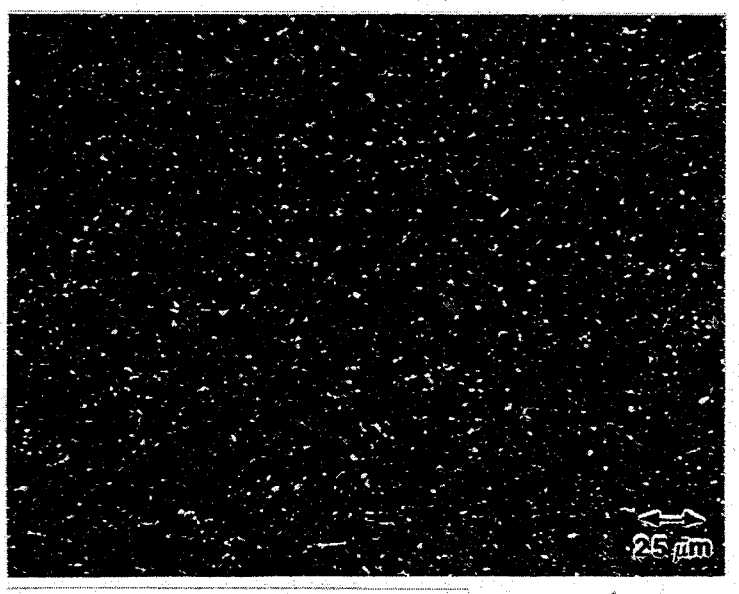
FIG. 2a ALLOY I. 400x
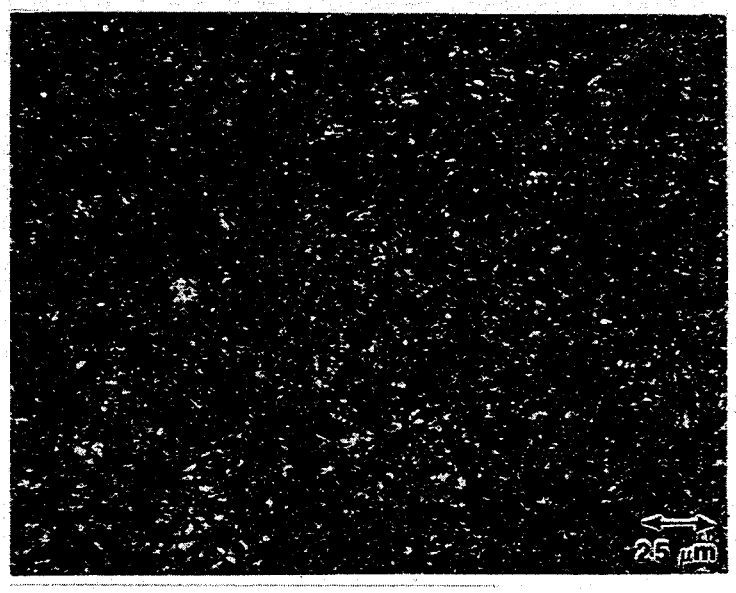
FIG. 2b ALLOY II. 400x

CASE CARBURIZED STAINLESS STEEL ALLOY FOR HIGH TEMPERATURE APPLICATIONS

BACKGROUND OF THE INVENTION

The present invention relates generally to corrosion resistant martensitic stainless steel alloys, and, more particularly, to a case hardenable stainless steel alloy suitable for use in high temperature bearing applications and like carburized components such as, for example, cams, shafts, bolts, gears and the like for use at high temperatures in corrosive atmospheres. The alloy of the invention, when case carburized and heat treated, provides an excellent combination of high surface hardness with hot hardness capabilities and core toughness.

Alloys used in such applications as bearings and gears require a high surface hardness for metal-to-metal wear resistance while maintaining a core exhibiting good fracture toughness, ductility and impact toughness for use in such applications as, for example, engines and transmissions. Currently used alloys include AMS 6278 (M50-NiL), as well as the alloys disclosed in U.S. Pat. Nos. 2,876,152; 4,004,952; 4,157,258 and 5,002,729. To date, such alloys provide these capabilities but fail to provide the additional properties of corrosion resistance and high hardness when used in high temperature applications. There is an increasing demand for alloys of this type at the present time which is expected to increase further in the future.

SUMMARY OF THE INVENTION

Briefly stated, the present invention is directed to an improved stainless steel alloy which provides corrosion resistance, high surface hardness at high temperature and core toughness.

The alloy of the invention preferably comprises (in weight %) about 0.10–0.25 carbon (C); 1.0 max manganese (Mn); 1.0 max silicon (Si); 13.0–19.0 chromium (Cr); 3.0–5.0 molybdenum (Mo); 0.25–1.25 vanadium (V); 1.75–5.25 nickel (Ni); 5.0–14.0 cobalt (Co); 0.01–0.10 niobium (Nb); 0.02 max boron (B); and the balance iron (Fe) and incidental impurities. A more preferred composition of the alloy of the invention comprises (in weight %) about 0.15–0.22 C; 0.3 max Mn; 0.3 max Si; 14.0–16.0 Cr; 3.5–4.5 Mo; 0.4–0.8 V; 3.0–4.2 Ni; 5.5–6.5 Co; 0.01–0.04 Nb; 0.001 max B; and balance Fe plus incidental impurities.

Another preferred composition of the alloy of the present invention comprises (in weight %) about 0.12–0.18 C; 0.2 max Mn; 0.25 max Si; 13.50–15.50 Cr; 4.0–5.0 Mo; 0.55–0.65 V; 1.75–2.25 Ni; 12.0–14.0 Co; 0.01–0.04 Nb; 0.001 max B; and balance Fe plus incidental impurities.

The term "incidental impurities" includes naturally occurring impurities and additions which do not diminish the desired properties of the alloy. In this regard, contents of up to about 0.015 wt. % phosphorous (P); 0.015 wt. % sulphur (S); 0.05 wt. % aluminum (Al); 0.01 wt. % copper (Cu); and 0.03 wt. % titanium (Ti) are permissible within the spirit of the invention.

The alloy is preferably ferrite-free or contains a minimum amount of ferrite so as to improve the subsequent case hardening properties of the article produced therefrom. In order to achieve this ferrite-free structure, the alloying elements are closely controlled to satisfy the following formula:

$$Cr+Mo+1.5\ Si+0.5\ Nb+2\ V-(Ni+0.5\ Co+0.5\ Mn+25\ C+30\ N)<25$$

The alloy composition is preferably prepared by vacuum induction melting (VIM), then vacuum arc remelting (VAR) to further refine the alloy. The refined ingot so produced is preferably stress relieved, homogenized, then hot worked, cooled and tempered. Preferably, the resultant article is normalized and annealed to provide a uniform austenitic structure. Articles made from the alloy are preferably preoxidized in air prior to carburizing. The articles are then preferably hardened by solution treating and austenitizing followed by air quenching, deep freezing and subsequent air warming. The articles may then be tempered and subjected to sub zero cooling for three consecutive treatments. The resultant articles exhibit a high surface hardness of at least 62 HRC at room temperature and at least about 58 HRC at elevated temperatures, approaching 800° F. (427° C.), while possessing excellent fracture toughness in the core over this temperature range. The articles made from the alloy, likewise, exhibit excellent corrosion resistance.

BRIEF DESCRIPTION OF THE DRAWINGS

FIG. 2*a* comprises a photomicrograph of Alloy I of the present invention enlarged to 400× on an optical microscope illustrating the distribution of carbides in the case microstructure;

FIG. 2*b* is a photomicrograph of Alloy II similar to FIG. 2*a*; and

DETAILED DESCRIPTION OF THE INVENTION

Figure 1:
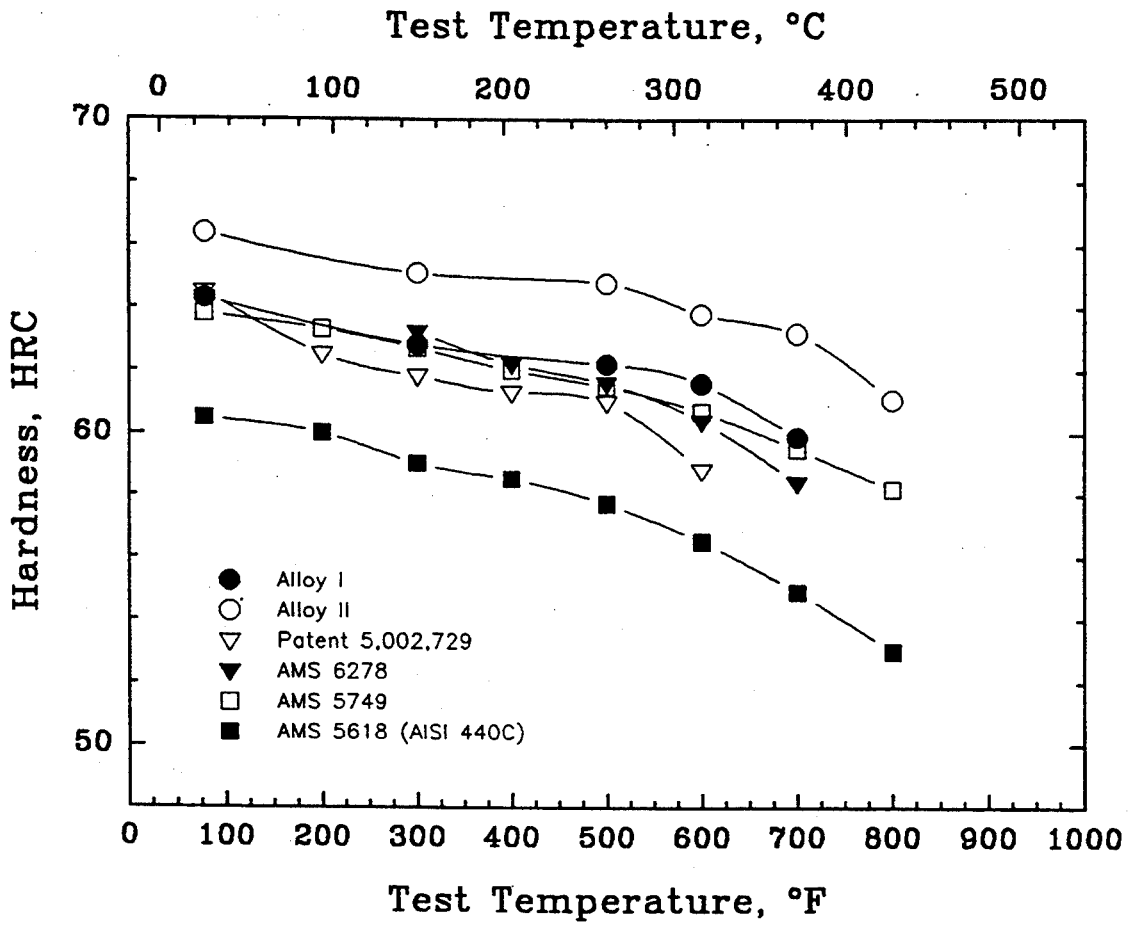
FIG. 1 is a graph of hardness versus temperature comparing alloys of the present invention to certain alloys of the prior art.

An important aspect of the present invention resides in the discovery that superior properties are obtained in a carburizable stainless steel alloy by combining a correct combination of nickel and cobalt to stabilize austenite and a correct combination of carbon and certain carbide forming elements; namely, molybdenum, chromium, vanadium and niobium. Presently preferred compositions of the alloy of the present invention are set forth in Table I, below.

TABLE I

| Element | Broad (wt. %) | Preferred I (wt. %) | Preferred II (wt. %) |
|---|---|---|---|
| C | 0.10–0.25 | 0.15–0.22 | 0.12–0.18 |
| Mn | 1.0 max | 0.3 max | 0.2 max |
| Si | 1.0 max | 0.3 max | 0.25 max |
| Cr | 13.0–19.0 | 14.0–16.0 | 13.50–15.50 |
| Mo | 3.0–5.0 | 3.5–4.5 | 4.0–5.0 |
| V | 0.25–1.25 | 0.4–0.8 | 0.55–0.65 |
| Ni | 1.75–5.25 | 3.0–4.2 | 1.75–2.25 |
| Co | 5.0–14.0 | 5.5–6.5 | 12.0–14.0 |
| Nb | 0.01–0.10 | 0.01–0.04 | 0.01–0.04 |
| B | 0.02 max | 0.001 max | 0.001 max |

Carbon plays a role in the formation of austenite at heat treating temperatures and is responsible for attaining high hardness levels in the heat treated condition. Carbon is also essential for forming the necessary carbides for strength, heat resistance and wear resistance. Preferably, carbon should be present in the alloy in an amount greater than 0.10 wt. %, and more preferably greater than 0.12 wt. %, or greater than 0.15 wt. %. The upper limit for carbon is about 0.25 wt. %.

Chromium contributes to the corrosion resistance of the alloy and may also be tied up as carbides in the alloy. Excessive amounts of chromium, however, may promote retained austenite and ferrite. Thus, chromium is controlled between 13–19 wt. %.

Nickel serves to stabilize austenite which, in turn, prevents the formation of undesired ferrite. Nickel also functions to increase fracture toughness properties in the alloy. Nickel, however, decreases the $M_s$ temperature which may prevent martensite formation.

Cobalt also acts as a strong austenite stabilizer to prohibit the formation of ferrite. The appropriate combination of nickel and cobalt allows for the presence of ferrite forming elements such as chromium, vanadium and molybdenum which are needed to form essential carbides in the alloy. In addition, cobalt offers distinct advantages in decreasing the tendency for delta-ferrite formation, while not depressing the $M_s$ temperature. Cobalt, unlike nickel, raises the $M_s$ temperature, thereby inhibiting the presence of retained austenite which may be detrimental in a case hardened alloy.

Molybdenum is a ferrite stabilizer; however, it raises the $Ac_1$ which improves the heat and temper resistance of the alloy. This is important for a case hardenable alloy. Molybdenum also expands the passivity range and enhances corrosion resistance.

Vanadium is a ferrite stabilizer and provides an excellent source of wear resistance and hot hardness by the formation of vanadium carbides. Although vanadium increases the ferrite forming potential of the alloy, it contributes to a fine grain structure necessary for strength and toughness by resisting plastic deformation and enhancing high temperature properties. Preferably, the vanadium content should be controlled up to amounts of 1.25 weight % since excessive amounts may tie up the carbon, and even more preferably, should be controlled to 0.8 weight %.

Niobium is critical to the invention. Niobium may be partially substituted for vanadium in the formation of finely dispersed carbides and also serves as an excellent source to pin grain boundaries, thus controlling grain size even more effectively and further increasing impact toughness. Since niobium has a greater affinity for carbon then chromium, niobium effectively ties up carbon, allowing chromium to be free for its function in corrosion resistance. As little as 0.02 weight % niobium is sufficient for the alloys of the present invention having carbon contents within the specified range.

Boron increases the hardenability, especially for low carbon alloys. Boron may also serve to improve both creep resistance and rupture strength and, when added in limited amounts, may greatly improve other high temperature properties such as hot hardness.

Manganese is effective as an austenite stabilizer and is known to tie up sulfur, which eliminates the risk of diffusion of sulfur to the grain boundaries and also contributes to lowering the $M_s$ temperature of the alloy. Although the allowable manganese content is 10 weight % manganese is preferably held below a maximum amount of 0.30 weight % since it may contribute to the retention of austenite when a martensitic matrix is preferred.

Silicon is a strong ferrite former and it is best kept to a minimum. A silicon content of up to 1.0% is allowable for its ability to improve the tempering characteristics of the steel. Preferably, silicon is kept to a 0.1 to 0.25 weight % content since the balance between austenite and ferrite is critical in a case hardenable alloy.

It is essential when making this alloy, that a balance of nickel and cobalt, austenite stabilizers, is made to offset the ferrite formers, molybdenum, vanadium and chromium. The following balanced combination of alloying elements, in weight %, provides a ferrite-free alloy best suited for subsequent case hardening:

$$Cr+Mo+1.5\ Si+0.5\ Nb+2\ V-(Ni+0.5\ Co+0.5\ Mn+25\ C+30\ N)<25$$

The balance of the alloy is essentially iron with incidental impurities and additions which do not diminish the desired properties. For example, contents up to about 0.015 wt. % phosphorous; 0.015 wt. % sulfur; 0.05 wt. % aluminum; 0.01 wt. % copper; and 0.03 wt. % titanium are permissible.

EXAMPLE I

A 2000 pound heat of steel formulated according to the present invention, designated as Alloy I, was melted and analyzed as follows, in weight %:

| | |
|---|---|
| carbon (C) | 0.15 |
| silicon (Si) | 0.28 |
| manganese (Mn) | 0.22 |
| chromium (Cr) | 14.45 |
| molybdenum (Mo) | 4.19 |
| vanadium (V) | 0.78 |
| nickel (Ni) | 4.07 |
| cobalt (Co) | 5.83 |
| niobium (Nb) | 0.02 |

the balance being iron, except for incidental impurities such as sulfur and phosphorous. The impurities were kept to a minimum of 0.002 weight % sulfur and 0.005 weight % phosphorous.

The Alloy I material was vacuum induction melted (VIM), then vacuum arc remelted (VAR) to produce a 12 inch ingot. The resultant ingot was stress relieved before further processing. The ingot was homogenized by heating to provide a uniform structure for hot working, then forged from a soak temperature of 2050° F. The hot worked material was then furnace cooled and tempered. The resultant material was given a normalizing heat treatment to produce a greater uniformity in the austenitic structure and to refine the grain size from the prior hot worked structure before annealing. In addition, the normalizing treatment effectively puts a quantity of carbides back into solution to subsequently produce a more uniform distribution of carbides which, upon later hardening, spheroidize and provide improved fracture toughness.

Bars made from this invention were oxidized in air at 1800° F. for two hours to prepare the surface for carburizing. The bars were then case hardened by gas carburizing and hardened by double austenitizing at 1925° F. After heat treating, the samples were air cooled, then subjected to a deep freeze at −110° F., and air warmed. Samples were then tempered at 925° F. for two hours and subjected to a deep freeze at −320° F. for three consecutive treatments. The tempered sample had a surface hardness of 64 HRC which would provide sufficient hardness for an average hot hardness of 60 HRC.

The results of hardness versus testing temperature are shown in FIG. 1 for the present invention. Case hardened and heat treated samples were also examined for case depth by optical and microhardness evaluation.

Figure 3:
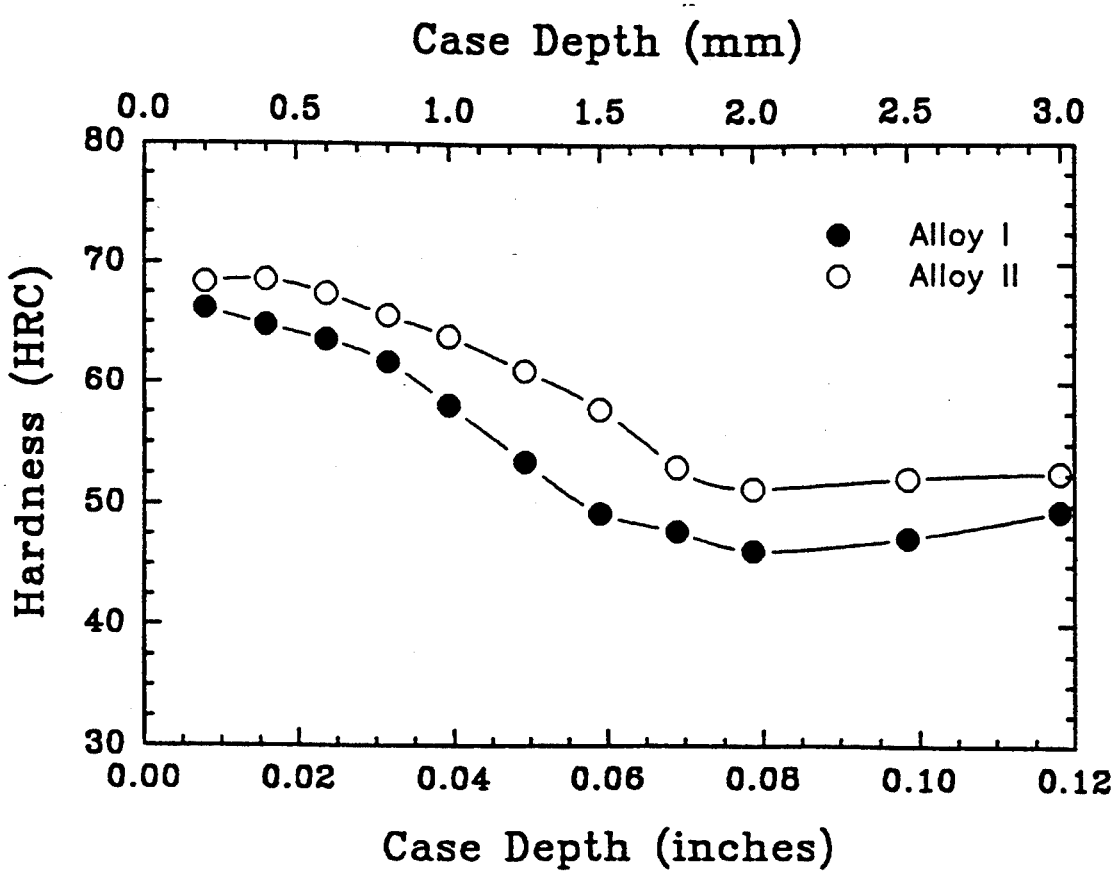
FIG. 3 is a graph of hardness versus case depth for Alloys I and II of the present invention.

Achieving a suitable carbide structure in the case of a stainless steel alloy is typically a challenge since chromium carbides form and tend to precipitate at the grain boundaries. The preferred structure achieved in the present invention may be attributed in part to the formation of niobium carbides. An example of the case hardened and heat treated case microstructure is shown in FIG. 2. The average case depth is illustrated in FIG. 3.

The corrosion resistance of Alloy I was also examined and tested in comparison to type 440C material, a typical stainless steel alloy used in applications corrosion resistance is required. Samples of the type 440C stainless and Alloy I of the invention were subjected to high humidity testing and $CuSO_4$ testing according to ASTM A380. Alloy I of the invention was found to have similar corrosion resistance as the type 440C material, which is considered to be excellent.

The core properties were also examined by mock carburizing material from annealed bars. Mock carburizing is a pseudo-carburizing cycle which would include the same heat treat cycle, however, it is performed in an inert environment to prevent the case from carburizing. Fracture toughness samples per ASTM E1304 were taken from an annealed bar such that the specimens were oriented transverse (T) to the direction of metal flow in the forged bar. The samples were then mock carburized and subjected to the same hardening cycle as enumerated hereinabove, with the exception that two tempering cycles were chosen to illustrate the variance in toughness with temperature. The same tempering procedure was applied for both as aforementioned. Samples were then machined and tested for fracture toughness per ASTM E1304. The fracture toughness of the alloys of the invention was found to be similar to AMS type 6278 material and is illustrated in Table II, which is considered to be excellent.

The mechanical properties of Alloy I are set forth in Table III and are considered to be excellent as well.

EXAMPLE 2

A 2000 pound heat of steel formulated according to the present invention, designated as Alloy II, was melted and analyzed as follows, in weight %:

| | |
|---|---|
| carbon (C) | 0.14 |
| silicon (Si) | 0.18 |
| manganese (Mn) | 0.14 |
| chromium (Cr) | 13.69 |
| molybdenum (Mo) | 4.71 |
| vanadium (V) | 0.60 |
| nickel (Ni) | 2.00 |
| cobalt | 12.74 |
| niobium (Nb) | 0.04 |

the balance being iron except for incidental impurities such as sulfur and phosphorous. The impurites were kept to a minimum of 0.002 w/o sulfur and 0.005 w/o phosphorous.

The Alloy II material was vacuum induction melted (VIM), then vacuum arc remelted (VAR) to produce a 12 inch ingot. The resultant ingot was stress relieved before further processing. The ingot was homogenized to provide a uniform structure for hot working then forged from a soak temperature of 2050° F. The hot worked material was then furnace cooled and tempered. The resultant material was given a normalizing heat treatment prior to annealing to produce a greater uniformity in the austenitic structure.

Bars made from Alloy II of the invention were case hardened by oxidizing in air at 1800° F. for two hours prior to gas carburizing. The samples were then hardened by solution treating at 1925° F. then austenitizing at 1900° F. After heat treating, the samples were air cooled, then subjected to a deep freeze at −110° F., then air warmed. Samples were then tempered at 925° F. for two hours and subjected to a deep freeze at −320° F. for three consecutive treatments. The tempered sample resulted in a surface hardness of 65 HRC which is a slight improvement over Alloy I in Example I. The results of hardness versus tempering temperature are also shown in FIG. 1 for the present invention. Case hardened and heat treated samples were also examined for case depth by optical and microhardness evaluation. An example of the case hardened and heat treated microstructure is shown in FIG. 2 with the average case depth illustrated in FIG. 3.

The corrosion resistance of the Alloy II material was also determined in comparison to type 440C stainless steel alloy. Samples of each material were subjected to high humidity testing and $CuSO_4$ in accordance with the test procedure of ASTM A380. Alloy II was found to have similar corrosion resistance as the type 440C alloy which is considered to be excellent.

The core properties were also examined by mock carburizing material from annealed bars of the Alloy II material. Fracture toughness samples per test procedure ASTM E1304 were taken from annealed bar such that some specimens were oriented transverse (T) to the direction of metal flow in the forged bar and some were oriented longitudinally (L) to the direction of metal flow in the forged bar. Rough machined samples were then mock carburized and subjected to the same hardening cycle as enumerated hereinabove. Once again, two separate tempering cycles were chosen to illustrate the variance in toughness with temperature. The same tempering procedure listed hereinabove was applied for both. Samples were then machined and tested for fracture toughness per ASTM E1304. When valid $K_{Ivj}$ could not be obtained, the maximum load was used to determine a valid $K_{IvM}$. The fracture toughness was found to be similar to AMS 6278 and is also illustrated in Table II.

TABLE II

| Alloy Tempering Temp °F. (°C.) | Sample Orientation | Test Temp °F. (°C.) | $K_{Ivj}$ ksi $\sqrt{in}$ | $K_{IvM}$ ksi $\sqrt{in}$ |
|---|---|---|---|---|
| Alloy I | | | | |
| 925 (496) | T | 77 (25) | 76.03 | 74.57 |
| 975 (524) | T | 77 (25) | 66.94 | 65.43 |
| Alloy II | | | | |
| 925 (496) | L | 77 (25) | 56.98 | 58.94 |
| 975 (524) | L | 77 (25) | — | 70.16 |
| 975 (524) | T | 77 (25) | — | 74.46 |
| 975 (524) | T | 77 (25) | 83.54 | 83.54 |

TABLE III

| | | MECHANICAL PROPERTY DATA | | | | |
|---|---|---|---|---|---|---|
| Sample | Tempering Temp, °F. (°C.) | YS ksi (MPa) | UTS ksi (MPa) | R.A. % | elongation % | Young's mod $\times 10^6$ ksi (GPa) |
| Alloy I | 925 (496) | 179.7 (1239.0) | 235.3 (1622.4) | 55.7 | 18.5 | 29.23 (201.5) |

TABLE III-continued

| Sample | Tempering Temp, °F. (°C.) | YS ksi (MPa) | UTS ksi (MPa) | R.A. % | elongation % | Young's mod $\times 10^6$ ksi (GPa) |
|---|---|---|---|---|---|---|
| | | MECHANICAL PROPERTY DATA | | | | |
| Alloy II | 925 (496) | 193.7 (1335.5) | 255.2 (1759.5) | 56.2 | 18.5 | 30.16 (207.9) |
| Alloy II | 975 (524) | 194.4 (1341.1) | 267.0 (1840.9) | 54.6 | 16.0 | 30.65 (211.3) |

The mechanical property data set forth in Table III indicates that Alloy II exhibits a higher yield strength and ultimate tensile strength than Alloy I under identical tempering temperatures. The strength levels for both Alloys I and II are thus considered to be superior.

This invention thus provides a case hardenable alloy which combines excellent corrosion resistance and fracture toughness along with superior hot hardness which makes the material desirable for higher temperature applications than heretofore possible with known alloys.

While specific embodiments of the invention have been described in detail, it will be appreciated by those skilled in the art that various modifications and alternatives to those details could be developed in light of the overall teachings of the disclosure. The presently preferred embodiments described herein are meant to be illustrative only and not limiting as to the scope of the invention which is to be given the full breadth of the appended claims and any and all equivalents thereof.

What is claimed is:

1. A case hardenable, corrosion resistant alloy for high temperature applications, consisting essentially of, in weight percent, about 0.10–0.25 C; 1.0 max Mn; 0.3 max Si; 13.0–19.0 Cr; 3.0–5.0 Mo; 0.25–1.25 V; 1.75–5.25 Ni; 5.0–14.0 Co; 0.01–0.10 Nb; 0.02 max B; and the balance essentially Fe and incidental impurities.

2. The alloy as recited in claim 1 containing no more than 0.22 weight percent carbon.

3. The alloy as recited in claim 1 containing no more than 0.001 weight percent boron.

4. The alloy as recited in claim 1 containing about: 0.15–0.22 C; 0.3 max Mn; 0.3 max Si; 14.0–16.0 Cr; 3.5–4.5 Mo; 0.4–0.8 V; 3.0–4.2 Ni; 5.5–6.5 Co; 0.01–0.04 Nb; 0.001 max B.

5. A case hardened and heat treated article formed from an alloy of claim 4 having a fracture toughness of at least 40 ksi $\sqrt{\text{in}}$ and having a core essentially free from ferrite, said article having a case hardness of at least about 62 HRC at room temperature, and a hot hardness of at least about 58 HRC at 700° F.

6. The alloy as recited in claim 1 containing no more than 0.18 weight percent carbon.

7. The alloy as recited in claim 1 containing an effective amount of austenite formers, nickel, cobalt, manganese, and carbon to balance an amount of ferrite formers, chromium, molybdenum, silicon, vanadium and niobium according to:

$$Cr+Mo+1.5\ Si+0.5\ Nb+2\ V-(Ni+0.5\ Co+0.5\ Mn+25\ C+30\ N)<25$$

8. The alloy as recited in claim 1 containing about: 0.12–0.18 C; 0.2 max Mn; 0.25 max Si; 13.5–15.5 Cr; 4.0–5.0 Mo; 0.55–0.65 V; 1.75–2.25 Ni; 12.0–14.0 Co; 0.01–0.04 Nb; 0.001 max B.

9. A case hardened and heat treated article formed from an alloy of claim 8 having a fracture toughness of at least 40 ksi $\sqrt{\text{in}}$ and having a core essentially free from ferrite, said article having a case hardness of at least about 64 HRC at room temperature, and a hot hardness of at least about 60 HRC at 700° F.

10. A case hardened, corrosion resistant article for high temperature applications, consisting essentially of, in weight percent: 0.10–0.25 C; 1.0 max Mn; 1.0 max Si; 13.0–19.0 Cr; 3.0–5.0 Mo; 0.25–1.25 V; 1.75–5.25 Ni; 5.0–14.0 Co; 0.01–0.10 Nb; 0.02 max B; and the balance essentially Fe and incidental impurities.

11. The article of claim 10 having a fracture toughness of at least 40 ksi $\sqrt{\text{in}}$ and having a core essentially free from ferrite, said article having a case hardness of at least about 62 HRC at room temperature and a hot hardness of at least about 58 HRC at 700° F.

12. A process for producing a case hardened, corrosion resistant article for high temperature applications, comprising:

(a) providing an alloy consisting essentially of, in weight percent: 0.10–0.25 C; 1.0 max Mn; 0.3 max Si; 13.0–19.0 Cr; 3.0–5.0 Mo; 0.25–1.25 V; 1.75–5.25 Ni; 5.0–14.0 Co; 0.01–0.10 Nb; 0.02 max B; and the balance essentially Fe and incidental impurities.

(b) vacuum induction melting said alloy;

(c) vacuum arc remelting said vacuum induction melted alloy to produce an ingot;

(d) heating and hot working said ingot to produce a worked shape;

(e) heat treating the shape to provide a uniform austenitic structure and a refined grain size;

(f) case hardening the shape;

(g) heat treating the case hardened shape.

13. The process of claim 12 wherein the heat treating of step (g) includes a double austenitizing treatment at about 1925° F., followed by air cooling and subsequent deep freezing at about −110° F., followed by air warming, followed by tempering at about 925° F. and deep freezing at about −110° F. followed by air warming.

14. The process of claim 12 wherein the case hardening step is accomplished by carburizing.

* * * * *